US010392779B2

(12) United States Patent
Kim et al.

(10) Patent No.: US 10,392,779 B2
(45) Date of Patent: Aug. 27, 2019

(54) METHOD OF CONTROLLING A MAIN CONTROL VALVE OF AN EXCAVATOR AND APPARATUS FOR PERFORMING THE SAME

(71) Applicant: Doosan Infracore Co., Ltd., Incheon (KR)

(72) Inventors: Ki-Yong Kim, Seoul (KR); Hyeon-Sik Ahn, Seoul (KR); Woo-Yong Jung, Seoul (KR); Chang-Mook Kim, Gyeonggi-do (KR)

(73) Assignee: DOOSAN INFRACORE CO., LTD., Dong-Gu, Incheon (KR)

( * ) Notice: Subject to any disclaimer, the term of this patent is extended or adjusted under 35 U.S.C. 154(b) by 81 days.

(21) Appl. No.: 15/683,107

(22) Filed: Aug. 22, 2017

(65) Prior Publication Data

US 2018/0066417 A1 Mar. 8, 2018

(30) Foreign Application Priority Data

Sep. 6, 2016 (KR) ..... 10-2016-0114233

(51) Int. Cl.
*E02F 9/22* (2006.01)
*F15B 11/17* (2006.01)
(Continued)

(52) U.S. Cl.
CPC ..... *E02F 9/2225* (2013.01); *E02F 9/2004* (2013.01); *E02F 9/2242* (2013.01);
(Continued)

(58) Field of Classification Search
CPC ..... E02F 9/2225; E02F 9/2242; E02F 9/2292; F15B 11/12; F15B 11/17; F15B 11/163; F15B 11/167
(Continued)

(56) References Cited

U.S. PATENT DOCUMENTS

2016/0252107 A1 9/2016 Kondo et al.

FOREIGN PATENT DOCUMENTS

EP 1672127 A2 6/2006
JP S58-146629 9/1983
(Continued)

OTHER PUBLICATIONS

Machine Translation of JP2006029468.*
Extended European Search Report issued in related European patent application No. 17187385.4 dated Jan. 17, 2018.

*Primary Examiner* — Michael Leslie
*Assistant Examiner* — Daniel S Collins
(74) *Attorney, Agent, or Firm* — K&L Gates LLP

(57) ABSTRACT

In a method of controlling a main control valve of an excavator, when speeds of a boom cylinder and an arm cylinder is increased by handling a boom joystick and an arm joystick, a second arm control spool between a first hydraulic pump and the arm cylinder may be closed. A first boom control spool between the first hydraulic pump and the boom cylinder may be opened to supply a first flux generated from the first hydraulic pump to the boom cylinder. A second boom control spool between a second hydraulic pump and the boom cylinder may be closed. A first arm control spool between the second hydraulic pump and the arm cylinder may be opened to supply a second flux generated from the second hydraulic pump to the arm cylinder.

8 Claims, 5 Drawing Sheets

(51) Int. Cl.
*E02F 9/20* (2006.01)
*F15B 13/06* (2006.01)
*E02F 3/42* (2006.01)

(52) U.S. Cl.
CPC ..... *E02F 9/2292* (2013.01); *F15B 11/17* (2013.01); *F15B 13/06* (2013.01); *E02F 3/425* (2013.01); *E02F 9/2267* (2013.01); *F15B 2211/20576* (2013.01); *F15B 2211/3059* (2013.01); *F15B 2211/35* (2013.01); *F15B 2211/51* (2013.01); *F15B 2211/523* (2013.01); *F15B 2211/6346* (2013.01); *F15B 2211/665* (2013.01); *F15B 2211/6654* (2013.01); *F15B 2211/7051* (2013.01); *F15B 2211/71* (2013.01); *F15B 2211/75* (2013.01)

(58) Field of Classification Search
USPC ..... 60/486
See application file for complete search history.

(56) References Cited

FOREIGN PATENT DOCUMENTS

| | | | | |
|---|---|---|---|---|
| JP | H-10-176347 | | 6/1998 | |
| JP | 2006029468 | * | 2/2006 | ..... F15B 11/02 |
| KR | 10-0923396 B1 | | 8/2005 | |

* cited by examiner

METHOD OF CONTROLLING A MAIN CONTROL VALVE OF AN EXCAVATOR AND APPARATUS FOR PERFORMING THE SAME

PRIORITY STATEMENT

This application claims priority under 35 U.S.C. § 119 to Korean Patent Application No. 10-2016-0114233, filed on Sep. 6, 2016 in the Korean Intellectual Property Office (KIPO), the contents of which are herein incorporated by reference in their entirety.

FIELD OF TECHNOLOGY

Example embodiments relate to a method of controlling a main control valve of an excavator and an apparatus for performing the same. More particularly, example embodiments relate to a method of controlling a main control valve configured to operate a boom and an arm of an excavator, and an apparatus for performing the method.

BACKGROUND

Generally, a boom and an arm of an excavator may be operated by a flux. The flux may be transferred to the boom and the arm from a hydraulic pump through a main control valve. A recent excavator may include a first hydraulic pump and a second hydraulic pump. Thus, the main control valve may include first and second boom control spools arranged between the first and second hydraulic pumps and a boom cylinder, and first and second arm control spools arranged between the first and second hydraulic pumps and an arm cylinder.

According to related arts, when the boom or the arm may be separately operated, a first flux generated from the first hydraulic pump and a second flux generated from the second hydraulic pump may be supplied to the boom cylinder or the arm cylinder through the first and second boom control spools or the first and second arm control spools.

When the boom and the arm may be simultaneously operated, the first flux may be partially supplied to the arm cylinder through the second arm control spool and the second flux may be partially supplied to the boom cylinder through the second boom control spool.

Therefore, when the boom and the arm may be simultaneously operated, a part of the first flux may pass through the second arm control spool and a part of the second flux may pass through the second boom control spool so that pressure loss may be generated.

SUMMARY

Example embodiments provide a method of controlling a main control valve of an excavator that may be capable of reducing pressure loss.

Example embodiments also provide an apparatus for performing the above-mentioned method.

According to example embodiments, there may be provided a method of controlling a main control valve of an excavator. In the method of controlling the main control valve of the excavator, when speeds of a boom cylinder and an arm cylinder is increased by handling a boom joystick and an arm joystick, a second arm control spool between a first hydraulic pump and the arm cylinder may be closed. A first boom control spool between the first hydraulic pump and the boom cylinder may be opened to supply a first flux generated from the first hydraulic pump to the boom cylinder. A second boom control spool between a second hydraulic pump and the boom cylinder may be closed. A first arm control spool between the second hydraulic pump and the arm cylinder may be opened to supply a second flux generated from the second hydraulic pump to the arm cylinder.

In example embodiments, supplying the first flux to the boom cylinder may include partially opening the second arm control spool to supply a part of the first flux to the arm cylinder.

In example embodiments, supplying the second flux to the arm cylinder may include partially opening the second boom control spool to supply a part of the second flux to the boom cylinder.

In example embodiments, the method may further include partially opening the second arm control spool to supply a part of the first flux to the arm cylinder when the boom joystick may be handled in a decreasing direction or the arm joystick may be handled in an increasing direction.

In example embodiments, the method may further include partially opening the second boom control spool to supply a part of the second flux to the boom cylinder when the boom joystick may be handled to an increasing direction or the arm joystick may be handled in a decreasing direction.

In example embodiments, the boom joystick may be partially handled compared than the arm joystick. The method may further include partially opening the second arm control spool to supply a part of the first flux to the arm cylinder when the boom joystick may be handled in a decreasing direction with stopping of the arm joystick after the boom joystick may be partially handled.

In example embodiments, the method may further include selectively controlling opening/closing of the first and second boom control spools and the first and second arm control spools by handling any one of the boom joystick and the arm joystick in an increasing direction or a decreasing direction after the speeds of the boom cylinder and the arm cylinder is increased by handling the boom joystick and the arm joystick.

According to example embodiments, there may be provided an apparatus for controlling a main control valve of an excavator. The apparatus may include a boom joystick, an arm joystick and a controller. The boom joystick may be configured to operate a first boom control spool between a first hydraulic pump and a boom cylinder, and a second boom control spool between the boom cylinder and a second hydraulic pump. The arm joystick may be configured to operate a first arm control spool between the second hydraulic pump and an arm cylinder, and a second arm control spool between the arm cylinder and the first hydraulic pump. The controller may be configured to selectively supply a first flux generated from the first hydraulic pump and a second flux generated from the second hydraulic pump to the first and second boom control spools and the first and second arm control spools in accordance with handing directions and handing strokes of the boom joystick and the boom joystick. When speeds of the boom cylinder and the arm cylinder is increased by handling the boom joystick and the arm joystick, the controller may close the second arm control spool and open the first boom control spool to supply the first flux to the boom cylinder. Further, the controller may close the second boom control spool and open the first arm control spool to supply the second flux to the arm cylinder.

In example embodiments, the controller may partially open the second arm control spool to supply a part of the first flux to the arm cylinder when the boom joystick may be handled in a decreasing direction or the arm joystick may be handled in an increasing direction.

In example embodiments, the controller may partially open the second boom control spool to supply a part of the second flux to the boom cylinder when the boom joystick may be handled in an increasing direction or the arm joystick may be handled in a decreasing direction.

In example embodiments, the boom joystick may be partially handled compared than the arm joystick. The controller may partially open the second arm control spool to supply a part of the first flux to the arm cylinder when the boom joystick may be handled in a decreasing direction with stopping of the arm joystick after the boom joystick may be partially handled.

In example embodiments, the controller may selectively control opening/closing of the first and second boom control spools and the first and second arm control spools by handling any one of the boom joystick and the arm joystick in an increasing direction or a decreasing direction after the speeds of the boom cylinder and the arm cylinder is increased by handling the boom joystick and the arm joystick.

According to example embodiments, when the boom and the arm may be simultaneously operated, the first flux may be supplied to the boom cylinder through only the first boom control spool and the second flux may be supplied to the arm cylinder through only the first arm control spools. Particularly, the second arm control spool and/or the second boom control spool may be selectively controlled by handling the boom joystick and/or the arm joystick. Therefore, a pressure loss caused by passing of the flux through the second boom control spool and the second arm control spool may be reduced.

BRIEF DESCRIPTION OF THE DRAWINGS

Example embodiments will be more clearly understood from the following detailed description taken in conjunction with the accompanying drawings.

FIG. 1 is a hydraulic circuit diagram illustrating a method of controlling a main control valve when only a boom is operated in accordance with example embodiments;

FIG. 2 is a hydraulic circuit diagram illustrating a method of controlling a main control valve when only an arm is operated in accordance with example embodiments;

FIG. 3 is a hydraulic circuit diagram illustrating a method of controlling a main control valve when fluxes are separately supplied to the boom and the arm without passing of the fluxes through a join spool in accordance with example embodiments;

FIG. 4 is a hydraulic circuit diagram illustrating a method of controlling a main control valve when a relatively great amount of the flux is supplied to the boom cylinder to increase a speed of the boom in accordance with example embodiments; and FIG. 5 is a hydraulic circuit diagram illustrating a method of controlling a main control valve when a relatively great amount of the flux is supplied to the arm cylinder to increase a speed of the arm in accordance with example embodiments.

DETAILED DESCRIPTION OF THE EMBODIMENTS

Figure 1:
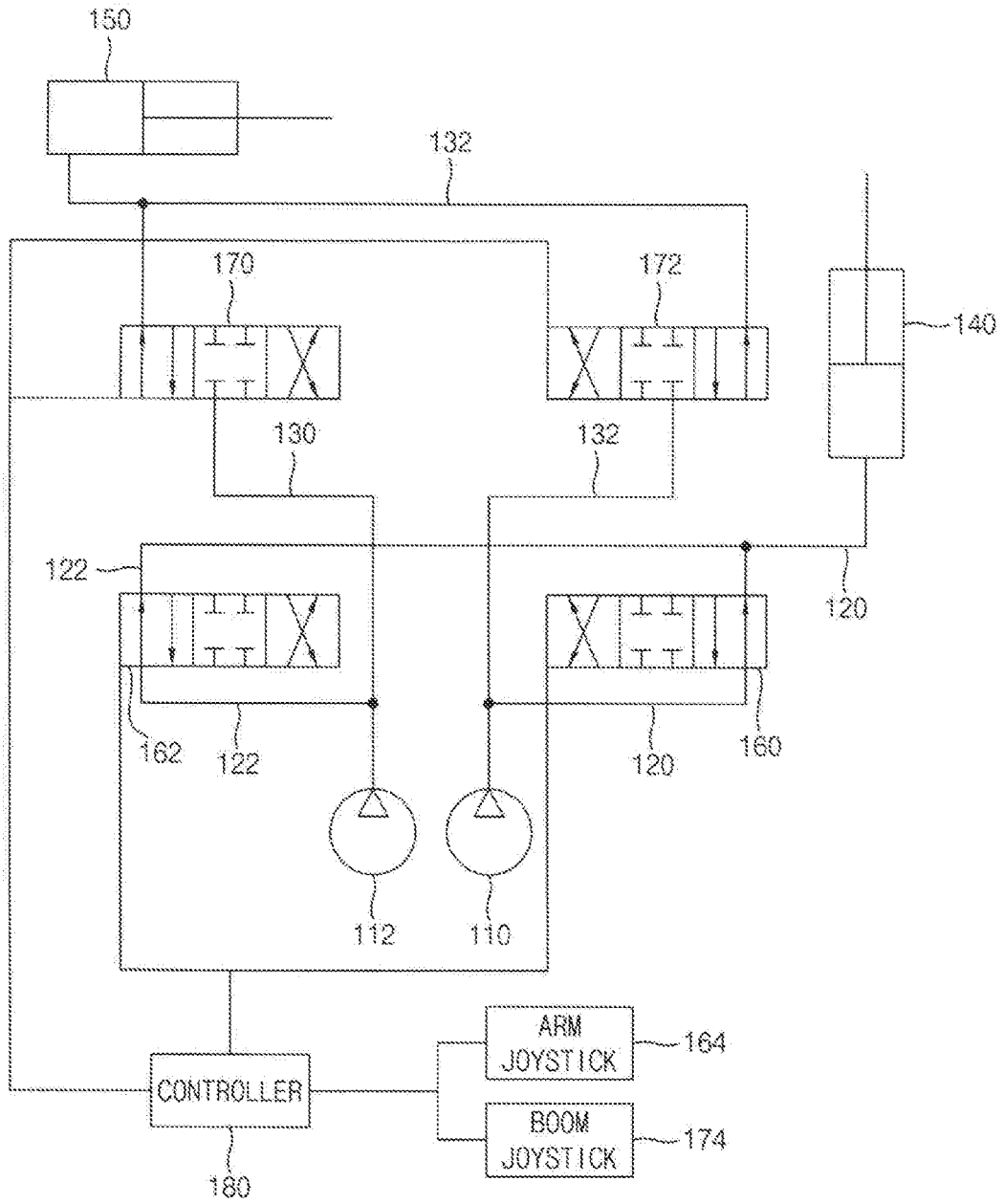
FIGS. 1 to 5 represent non-limiting, example embodiments as described herein.

Various example embodiments will be described more fully hereinafter with reference to the accompanying drawings, in which some example embodiments are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments will be explained in detail with reference to the accompanying drawings.

FIG. 1 is a hydraulic circuit diagram illustrating a method of controlling a main control valve when only a boom is operated in accordance with example embodiments.

Referring to FIG. 1, an excavator may include a first hydraulic pump 110, a second hydraulic pump 112, a main control valve, a boom cylinder 140 and an arm cylinder 150.

The first hydraulic pump 110 may be configured to generate a first flux. The second hydraulic pump 112 may be configured to generate a second flux. In example embodiments, the first flux and the second flux may have substantially the same pressure. Alternatively, the first flux and the second flux may have different pressures.

The main control valve may be arranged between the first and second hydraulic pumps 110 and 112 and the boom and arm cylinders 140 and 150. The main control valve may be configured to selectively supply the first and second fluxes to the boom cylinder 140 and the arm cylinder 150.

The boom cylinder 140 may be connected with a boom. The boom cylinder 140 may be configured to supply the first flux and/or the second flux to the boom. The arm cylinder 150 may be connected with an arm. The arm cylinder 150 may be configured to supply the first flux and/or the second flux to the arm.

The first hydraulic pump 110 may be connected with the boom cylinder 140 through a first boom line 120. The second hydraulic pump 112 may be connected with the boom cylinder 140 through a second boom line 122.

The second hydraulic pump 112 may be connected with the arm cylinder 150 through a first arm line 130. The first hydraulic pump 110 may be connected with the arm cylinder 150 through a second arm line 132.

The main control valve may include a first boom control spool 160, a second boom control spool 162, a first arm control spool 170 and a second arm control spool 172.

The first boom control spool 160 may be installed on the first boom line 120. The second boom control spool 162 may be installed on the second boom line 122. The first boom control spool 160 and the second boom control spool 162 may be controlled by control signals of a controller 180 in accordance with handling directions and handling strokes of a boom joystick 164.

The first arm control spool 170 may be installed on the first arm line 130. The second arm control spool 172 may be installed on the second arm line 132. The first arm control spool 170 and the second arm control spool 172 may be controlled by control signals of the controller 180 in accordance with handling directions and handling strokes of an arm joystick 174.

When only the boom may be operated, the first arm control spool 170 and the second arm control spool 172 may be closed by the control signal of the controller 180 in accordance with handling of the arm joystick 174. In contrast, the first boom control spool 160 and the second boom control spool 162 may be opened by the control signal of the controller 180 in accordance with handling of the boom joystick 164. Thus, 100% of the first flux generated from the first hydraulic pump 110 may be transferred to the boom cylinder 140 through the first boom line 120. Further, 100% of the second flux generated from the second hydraulic pump 112 may be transferred to the boom cylinder 140 through the second boom line 122. As a result, because all of the first flux and the second flux may be supplied to the boom cylinder 140, a total flux supplied to the boom cylinder 140 may be a sum of 100% of the first flux and 100% of the second flux.

Figure 2:
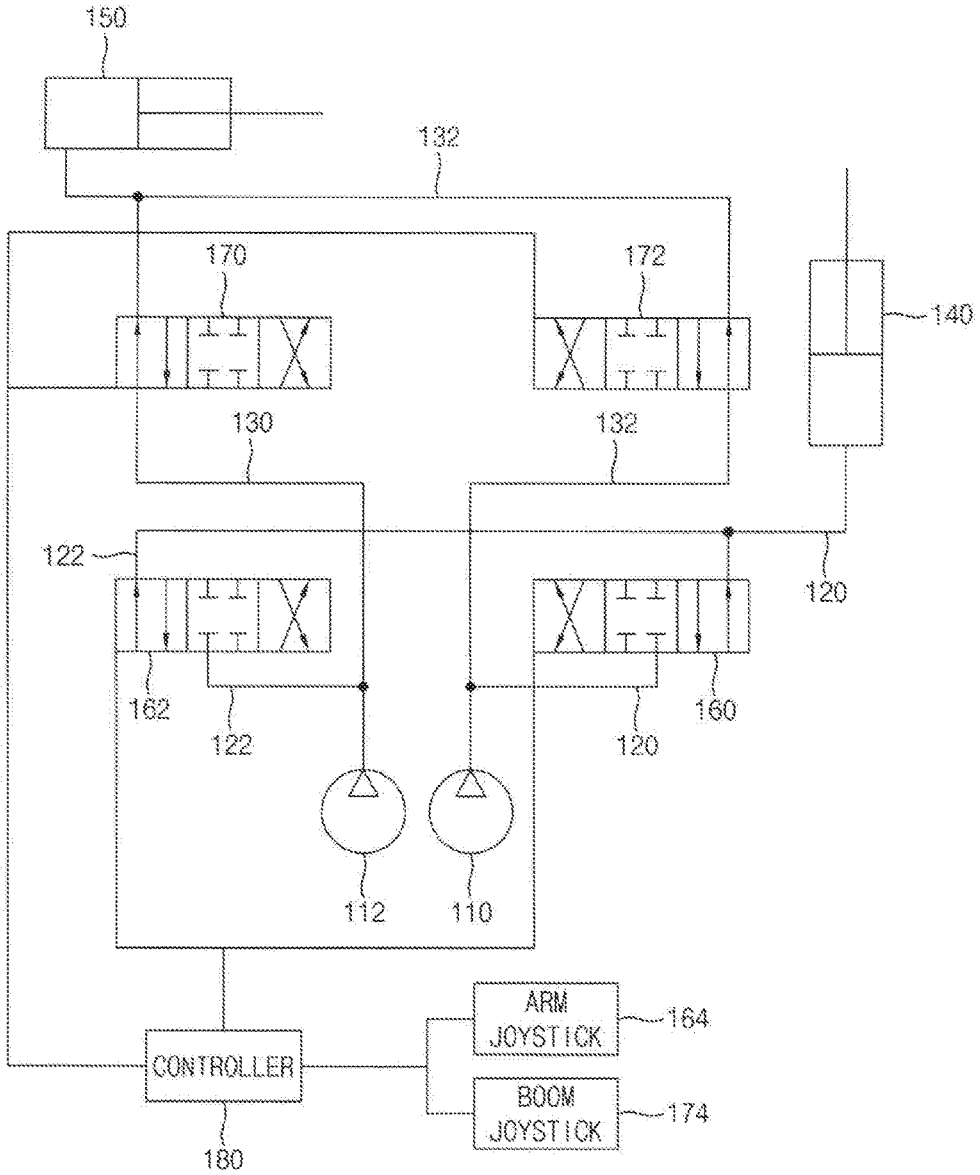

FIG. 2 is a hydraulic circuit diagram illustrating a method of controlling a main control valve when only an arm is operated in accordance with example embodiments.

When only the arm may be operated, the first boom control spool 160 and the second boom control spool 162 may be closed by the control signal of the controller 180 in accordance with handling of the boom joystick 164. In contrast, the first arm control spool 170 and the second arm control spool 172 may be opened by the control signal of the controller 180 in accordance with handling of the arm joystick 174. Thus, 100% of the first flux generated from the first hydraulic pump 110 may be transferred to the arm cylinder 150 through the first arm line 130. Further, 100% of the second flux generated from the second hydraulic pump 112 may be transferred to the arm cylinder 150 through the second arm line 132. As a result, because all of the first flux and the second flux may be supplied to the arm cylinder 150, a total flux supplied to the arm cylinder 150 may be a sum of 100% of the first flux and 100% of the second flux.

Figure 3:
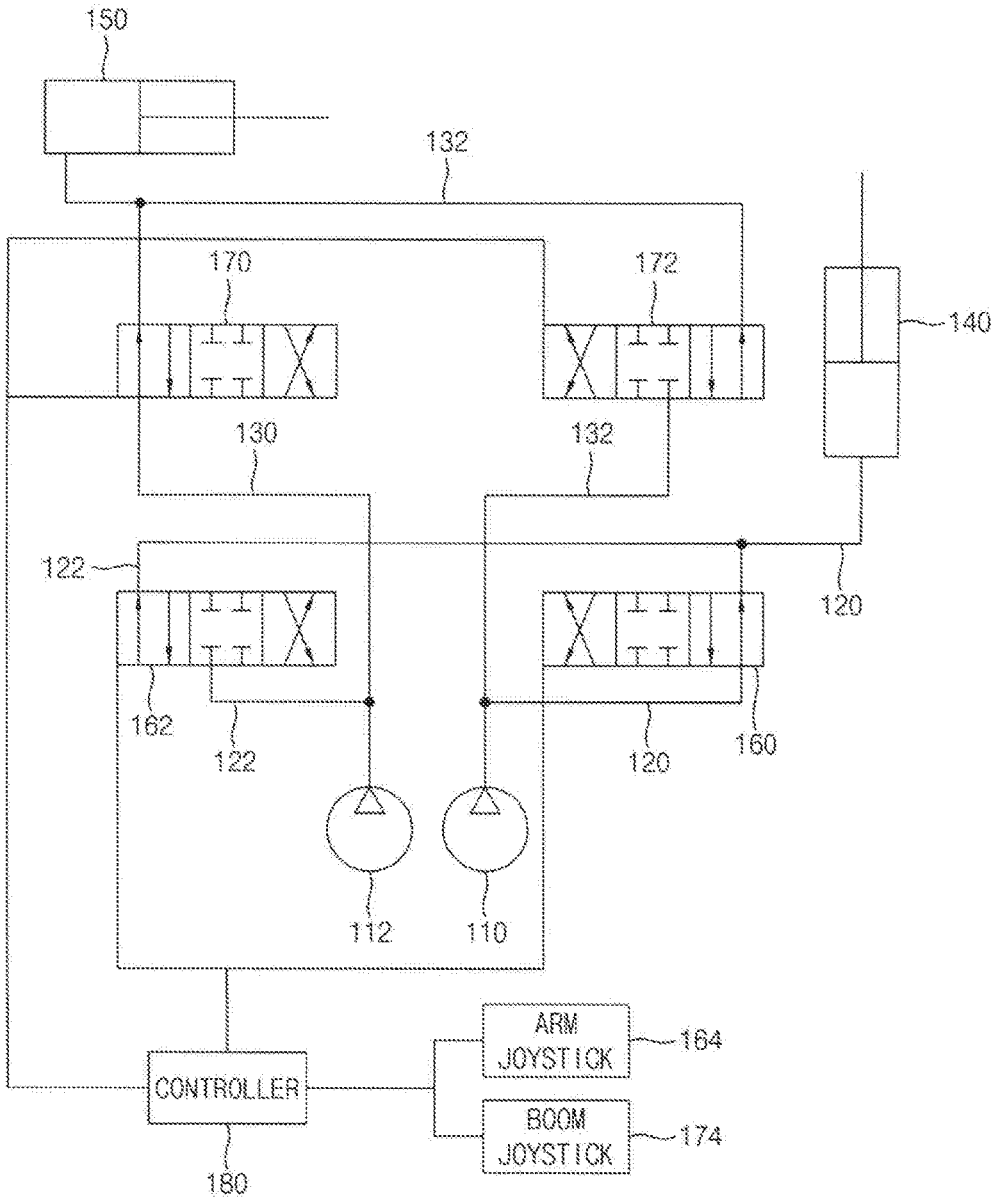

FIG. 3 is a hydraulic circuit diagram illustrating a method of controlling a main control valve when fluxes are separately supplied to the boom and the arm without passing of the fluxes through a join spool in accordance with example embodiments.

When the speeds of the boom and the arm is increased, the second arm control spool 172 and the second boom control spool 162 may be closed by the control signal of the controller 180 in accordance with handlings of the boom joystick 164 and the arm joystick 174. In contrast, the first boom control spool 160 and the first arm control spool 170 may be opened by the control signal of the controller 180 in accordance with handlings of the boom joystick 164 and the arm joystick 174. Thus, the first flux generated from the first hydraulic pump 110 may not be supplied to the arm cylinder 150. The first flux may be supplied to only the boom cylinder 140 through the first boom line 120. Further, the second flux generated from the second hydraulic pump 112 may not be supplied to the boom cylinder 140. The second flux may be supplied to only the arm cylinder 150 through the first arm line 130.

Therefore, when the speeds of the boom and the arm is increased, the hydraulic circuit connected with the boom cylinder may be separated from the hydraulic circuit connected with the arm cylinder 150. The first flux generated from the first hydraulic pump 110 may be supplied to the boom cylinder 140 through only one first boom control spool 160. The second flux generated from the second hydraulic pump 112 may be supplied to the arm cylinder 150 through only one first arm control spool 170. As a result, a pressure loss caused by passing of the fluxes through the second control spools may be reduced.

Figure 4:
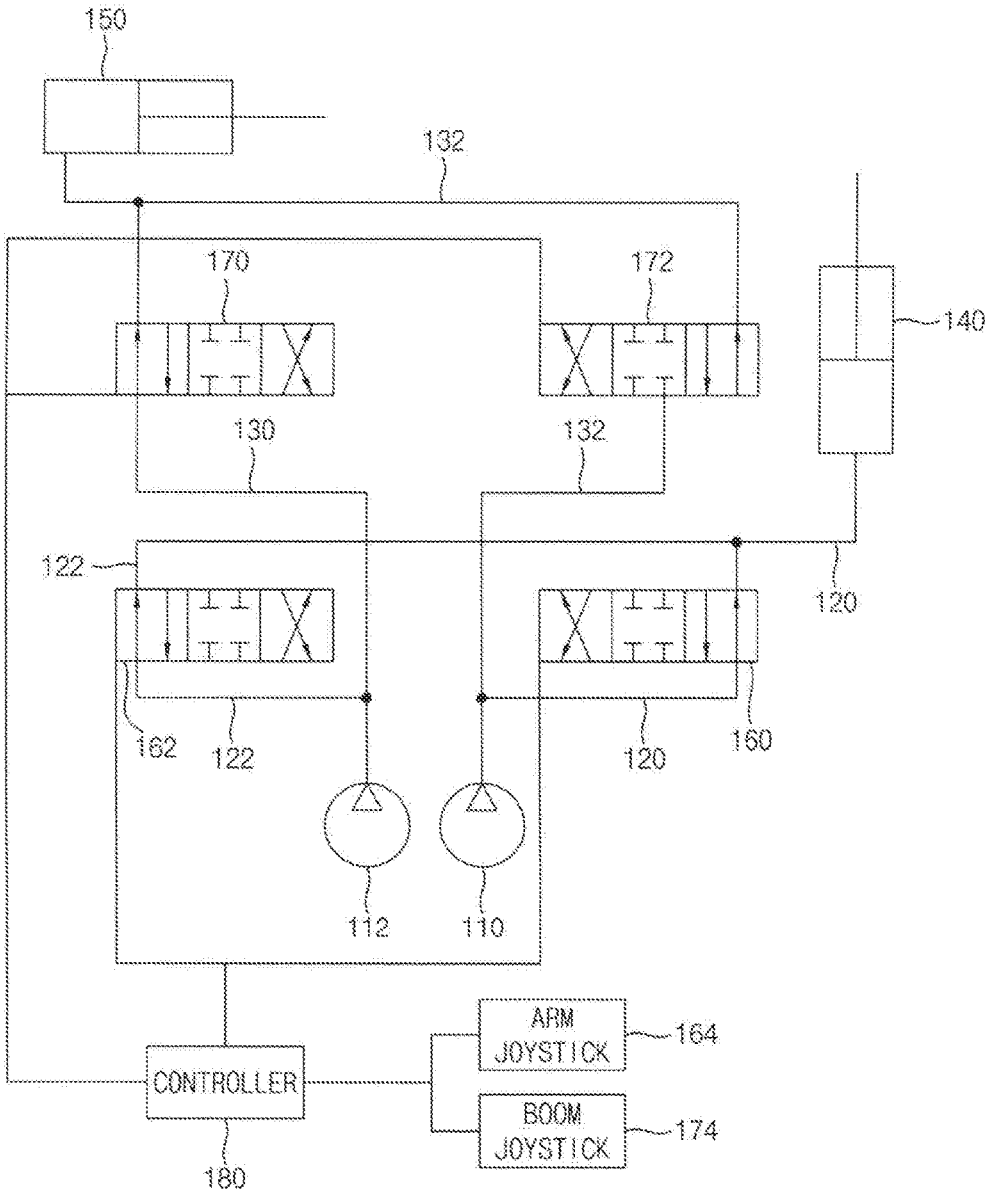

FIG. 4 is a hydraulic circuit diagram illustrating a method of controlling a main control valve when a relatively great amount of the flux is supplied to the boom cylinder to increase a speed of the boom in accordance with example embodiments.

When the speed of the arm may be decreased so as to provide the boom with the speed faster than the speed of the arm, a worker may handle the boom joystick 164 in an increasing direction or the arm joystick 174 in a decreasing direction. The controller 180 may determine the increasing of the speed of the boom to close the second arm control spool 172. In contrast, the first boom control spool 160 and the first arm control spool 170 may be opened. The second boom control spool 162 may be partially opened. Thus, the first flux generated from the first hydraulic pump 110 may not be supplied to the arm cylinder 150. The first flux may be supplied to the boom cylinder 140 through the first boom line 112. Further, a great part of the second flux generated from the second hydraulic pump 112 may be supplied to the arm cylinder 150 through the first arm line 130. A part of the second flux may be supplied to the boom cylinder 140 through the second boom line 122.

Therefore, a total flux supplied to the boom cylinder 140 may be a sum of 100% of the first flux and the part of the second flux. Further, a total flux supplied to the arm cylinder 150 may be the great part of the second flux except for the part of the second flux passing through the second boom line 122. As a result, because the total flux supplied to the boom cylinder 140 may be higher than the total flux supplied to the arm cylinder 150, the speed of the boom may be increased and the speed of the arm may be decreased.

Figure 5:
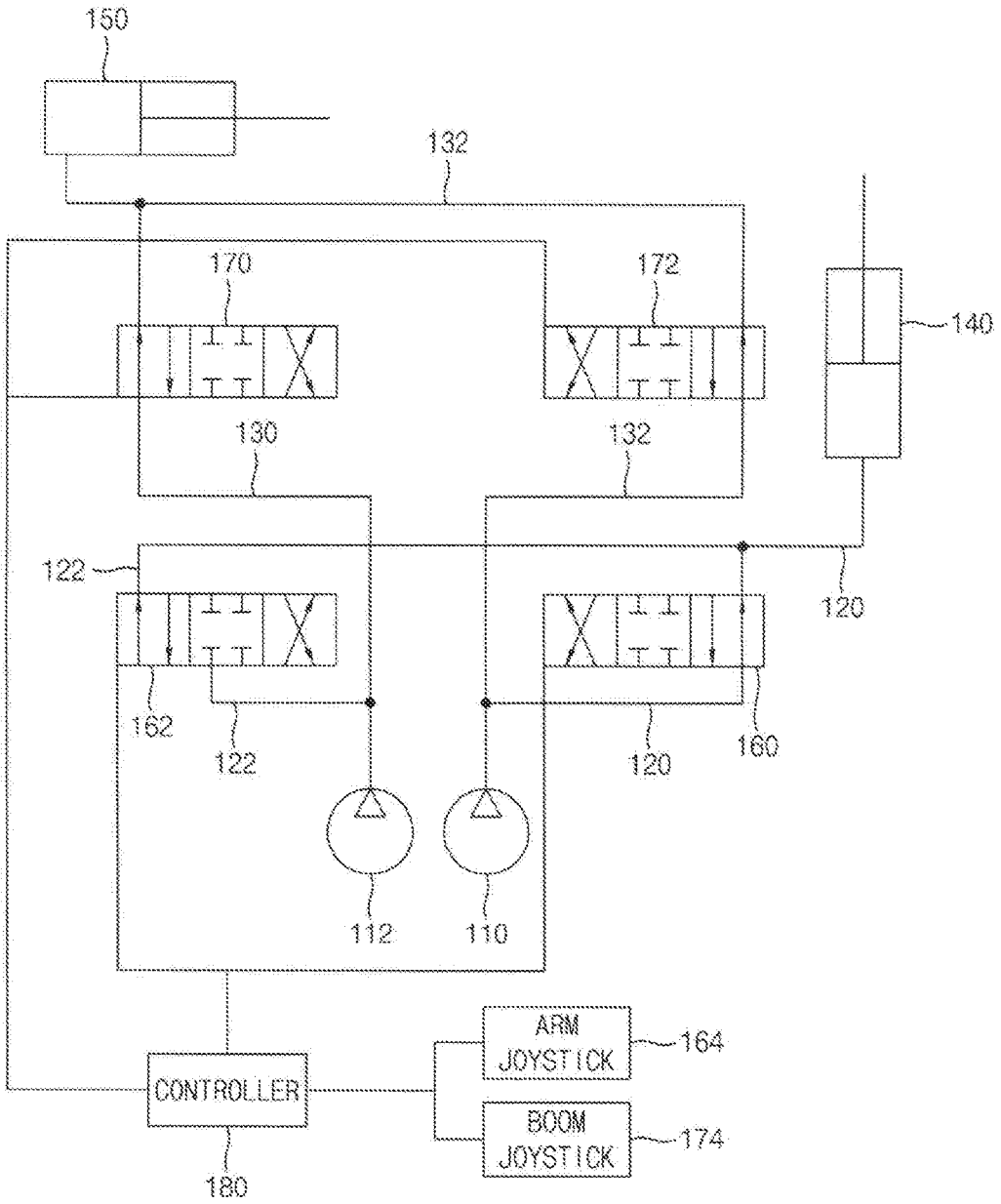

FIG. 5 is a hydraulic circuit diagram illustrating a method of controlling a main control valve when a relatively great amount of the flux is supplied to the arm cylinder to increase a speed of the arm in accordance with example embodiments.

When the speed of the boom may be decreased so as to provide the arm with the speed faster than the speed of the boom, a worker may handle the boom joystick 164 in the decreasing direction or the arm joystick 174 in the increasing direction wherein a displacement of the boom joystick 164 may be less than a displacement of the arm joystick 174. The controller 180 may determine the increasing of the speed of the arm to close the second boom control spool 162. In contrast, the first boom control spool 160 and the first arm control spool 170 may be opened. The second arm control spool 172 may be partially opened. Thus, a great part of the first flux generated from the first hydraulic pump 110 may be supplied to the boom cylinder 140 through the first boom line 120. A part of the first flux may be supplied to the arm cylinder 150 through the second arm line 132. Further, the second flux generated from the second hydraulic pump 112 may not be supplied to the boom cylinder 140. The second flux may be supplied to the arm cylinder 150 through the first arm line 130.

Further, the boom joystick 164 may be partially handled compared than the arm joystick 174. After partially handling the boom joystick 164, when the boom joystick 164 may be handled in the decreasing direction with stopping of the arm joystick 174, the second boom control spool 162 may be closed. In contrast, the first boom control spool 160 and the first arm control spool 170 may be opened. The second arm control spool 172 may be partially opened.

Therefore, a total flux supplied to the arm cylinder 150 may be a sum of 100% of the second flux and the part of the first flux. Further, a total flux supplied to the boom cylinder 140 may be the great part of the first flux except for the part of the first flux passing through the second arm line 132. As a result, because the total flux supplied to the arm cylinder 150 may be higher than the total flux supplied to the boom cylinder 140, the speed of the arm may be increased and the speed of the boom may be decreased.

As mentioned above, after the speeds of the boom cylinder 140 and the arm cylinder 150 is increased by handling the boom joystick 164 and the arm joystick 174, the controller 180 may selectively open/close the first and second boom control spools 160 and 162 and the first and second arm control spools 170 and 172 in accordance with the handling directions of any one of the boom joystick 164 and the arm joystick 174 so that the pressure loss may be reduced.

According to example embodiments, when the boom and the arm may be simultaneously operated, the first flux may be supplied to the boom cylinder through only the first boom control spool and the second flux may be supplied to the arm cylinder through only the first arm control spools. Particularly, the second arm control spool and/or the second boom control spool may be selectively controlled by handling the boom joystick and/or the arm joystick. Therefore, the pressure loss caused by passing of the flux through the second boom control spool and the second arm control spool may be reduced.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of controlling a main control valve of an excavator when speeds of a boom cylinder and an arm cylinder are increased by handling a boom joystick and an arm joystick, the method comprising:

closing a second arm control spool between a first hydraulic pump and the arm cylinder;

opening a first boom control spool between the first hydraulic pump and the boom cylinder to supply a first flux generated from the first hydraulic pump to the boom cylinder;

closing a second boom control spool between a second hydraulic pump and the boom cylinder;

opening a first arm control spool between the second hydraulic pump and the arm cylinder to supply a second flux generated from the second hydraulic pump to the arm cylinder; and partially opening the second arm control spool to supply a part of the first flux to the arm cylinder in response to the boom joystick being handled in a decreasing direction of the speed of the boom cylinder, wherein a displacement of the boom joystick is less than a displacement of the arm joystick.

2. The method of claim 1, wherein supplying the second flux to the arm cylinder comprises partially opening the second boom control spool to supply a part of the second flux to the boom cylinder.

3. The method of claim 1, further comprising partially opening the second arm control spool to supply a part of the first flux to the arm cylinder when the boom joystick is handled in a decreasing direction of the speed of the boom cylinder or the arm joystick is handled in an increasing direction of the speed of the arm cylinder.

4. The method of claim 1, further comprising partially opening the second boom control spool to supply a part of the second flux to the boom cylinder when the boom joystick is handled in an increasing direction of the speed of the boom cylinder or the arm joystick is handled in a decreasing direction of the speed of the boom cylinder.

5. The method of claim 1, further comprising selectively controlling opening and closing the first and second boom control spools and the first and second arm control spools by handling at least one of the boom joystick and the arm joystick in a direction selected from the group consisting of an increasing direction and a decreasing direction of the speeds of the boom cylinder and the arm cylinder after increasing the speeds of the boom cylinder and the arm cylinder by handling the boom joystick and the arm joystick.

6. An apparatus for controlling a main control valve of an excavator, the apparatus comprising:

a boom joystick configured to operate a first boom control spool between a first hydraulic pump and a boom cylinder and a second boom control spool between the boom cylinder and a second hydraulic pump;

an arm joystick configured to operate a first arm control spool between the second hydraulic pump and an arm cylinder and a second arm control spool between the arm cylinder and the first hydraulic pump; and a controller configured to selectively supply a first flux generated from the first hydraulic pump and a second flux generated from the second hydraulic pump to the first and second boom control spools and the first and second arm control spools in accordance with handling directions and handling strokes of the boom joystick and the arm joystick, wherein the controller closes the second arm control spool and opens the first boom control spool to supply the first flux to the boom cylinder, and closes the second boom control spool and opens the first arm control spool to supply the second flux to the arm cylinder when speeds of the boom cylinder and the arm cylinder are increased by handling the boom joystick and the arm joystick, and wherein the controller partially opens the second arm control spool to supply a part of the first flux to the arm cylinder in response to the boom joystick being handled in a decreasing direction of the speed of the boom cylinder, wherein a displacement of the boom joystick is less than a displacement of the arm joystick.

7. The apparatus of claim 6, wherein the controller partially opens the second boom control spool to supply a part of the second flux to the boom cylinder when the boom joystick is handled in an increasing direction of the speed of the boom cylinder or the arm joystick is handled in a decreasing direction of the speed of the arm cylinder.

8. The apparatus of claim 6, wherein the controller selectively controls opening and closing the first and second boom control spools and the first and second arm control spools by handling at least one of the boom joystick and the arm joystick in a direction selected from the group consisting of an increasing direction and a decreasing direction of the speeds of the boom cylinder and the arm cylinder after increasing the speeds of the boom cylinder and the arm cylinder by handling the boom joystick and the arm joystick.

* * * * *